US007889151B1

(12) United States Patent
Brock et al.

(10) Patent No.: US 7,889,151 B1
(45) Date of Patent: Feb. 15, 2011

(54) PASSIVE WIDE-BAND LOW-ELEVATION NULLING ANTENNA

(75) Inventors: David W. Brock, San Diego, CA (US); Peter S. Berens, San Diego, CA (US); Bruce D. Calder, San Diego, CA (US); Terence R. Albert, La Jolla, CA (US); Robbi Mangra, San Diego, CA (US); Hale B. Simonds, Santee, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 768 days.

(21) Appl. No.: 11/937,321

(22) Filed: Nov. 8, 2007

(51) Int. Cl.
*H01Q 1/36* (2006.01)

(52) U.S. Cl. ..... 343/895; 343/700 MS

(58) Field of Classification Search ..... 343/895, 343/761, 700 MS, 872
See application file for complete search history.

(56) References Cited

U.S. PATENT DOCUMENTS 3,735,409 A 5/1973 Gershberg et al.
4,032,921 A * 6/1977 Sikina et al. ..... 343/730
4,658,262 A * 4/1987 DuHamel ..... 343/792.5
5,451,973 A 9/1995 Walter et al.
5,589,842 A * 12/1996 Wang et al. ..... 343/787
2002/0067315 A1* 6/2002 Kunysz ..... 343/770
2004/0056822 A1* 3/2004 McCarthy et al. ..... 343/895
2008/0284673 A1* 11/2008 Delgado et al. ..... 343/895

* cited by examiner

*Primary Examiner*—HoangAnh T Le
(74) *Attorney, Agent, or Firm*—Ryan J. Friedl; Kyle Eppele

(57) ABSTRACT

An antenna includes a support structure and radiating element. The radiating element includes a dielectric planar substrate having a first and a second surface, at least two conductive spiral arms extending outward from and spiraling about an axis of rotation formed on the first surface, and a feed conductor extending outward from and spiraling about an axis of rotation formed on the second surface. The feed conductor may be substantially aligned with one of the conductive spiral arms. When the support structure is placed upon a substantially planar surface, the radiating element is positioned at height h from the planar surface, wherein height h is about one-fourth the wavelength of the antenna's operating frequency. The antenna may produce an omni-directional antenna pattern in azimuth and a broad antenna pattern in elevation, with both patterns having nulls near the horizon. An external reflector may be operatively coupled to the antenna.

19 Claims, 11 Drawing Sheets

PASSIVE WIDE-BAND LOW-ELEVATION NULLING ANTENNA

FEDERALLY-SPONSORED RESEARCH AND DEVELOPMENT

The Passive Wide-Band Low-Elevation Nulling Antenna was developed with Federal funds and is assigned to the United States Government. Licensing inquiries may be directed to Office of Research and Technical Applications, Space and Naval Warfare Systems Center, San Diego, Code 2112, San Diego, Calif., 92152; telephone 619-553-2778; email: T2@spawar.navy.mil. Reference Navy Case No. 98862.

BACKGROUND OF THE INVENTION

The invention relates generally to the field of antennas.

Most antennas for satellite communications or GPS are omni-directional and do not have a null at the horizon. Other directional antennas must be pointed directly at the satellite. These antennas have better gain, but require a movable mount and a mechanical or electrical tracking system if the satellites are not geo-stationary. During operation directional antennas require extra time for aiming at the satellite, making them more difficult to use on the battlefield. One particular type of antenna, controlled radiation pattern antennas (CRPA's), have generally been effective against jammers. Although CRPA's can null jamming or interference source at any elevation angle, they can null only a small number of interference sources. Because the CRPA antenna array is large and the adaptive beamformer requires a sizable power source, CRPA's are not readily transportable by a user.

Therefore, there is a need for a small, lightweight, easily concealed, wideband, wide beam pattern, readily human transportable and deployable antenna that is able to transmit and receive signals to and from satellites at any position relative to the antenna, and that can also null jamming or interference sources near the horizon.

DETAILED DESCRIPTION OF SOME EMBODIMENTS

Figure 1:
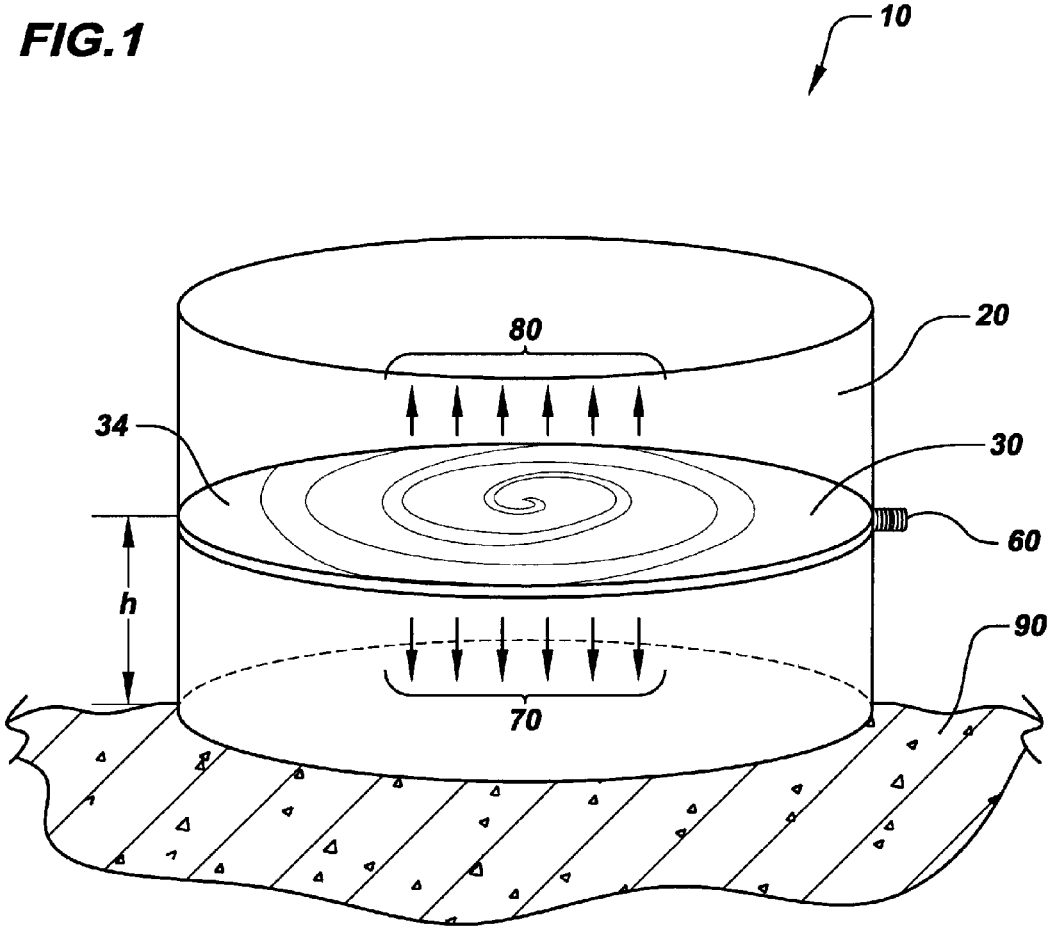
FIG. 1 shows a front perspective view of an embodiment of the passive wideband low elevation nulling antenna.
Figure 2A:
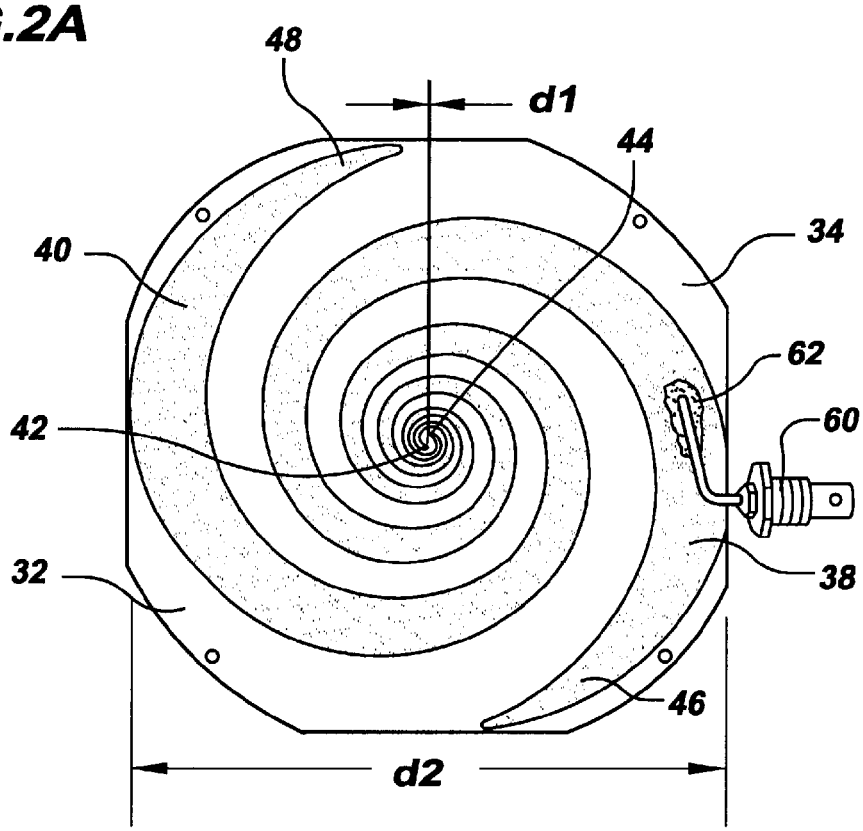
FIG. 2A shows a top view of the first surface of an embodiment of the radiating element of the passive wideband low elevation nulling antenna.
Figure 2B:
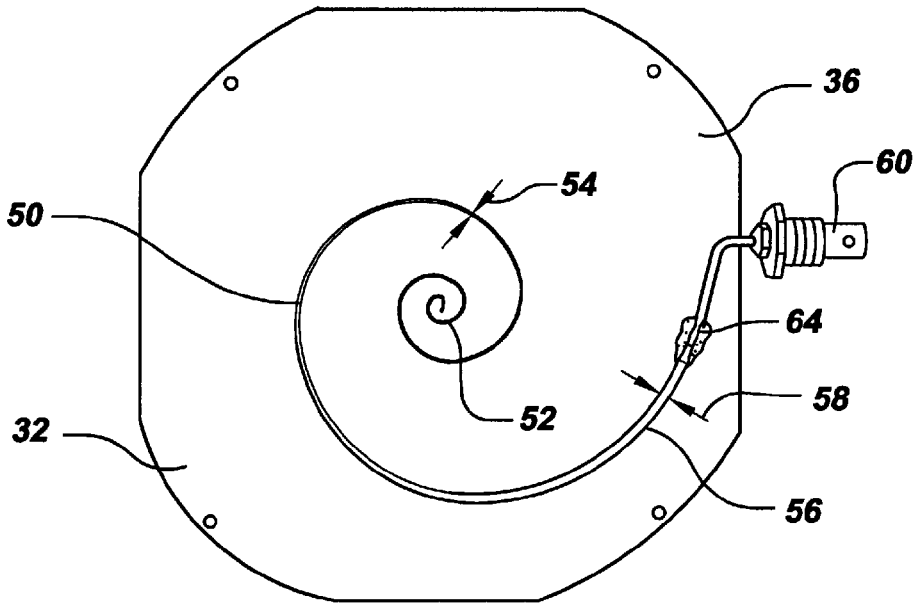
FIG. 2B shows a top view of the second surface of an embodiment of the radiating element of the passive wideband low elevation nulling antenna.

Referring to FIGS. 1 and 2, there is shown an embodiment of the passive wide-band low-elevation nulling antenna 10. Antenna 10 may include a support structure 20 and a radiating element 30 attached thereto. Support structure 20 may include a mounting structure (see for example, reference 318 of FIG. 10) that runs along the inner wall of housing 20 and allows radiating element to be seated parallel to and spaced from the ground or a reflector plate by height h. Height h may be varied depending on the wavelength of the operating frequency of the antenna. For example if h is 4.7 centimeters antenna 10 may operate in the frequency range of about 800 MHz to about 2.4 GHz.

Radiating element 30 may include a dielectric planar substrate 32 having a first surface 34 and a second surface 36, at least two conductive spiral arms 38 and 40 extending outward from and spiraling about an axis of rotation formed on first surface 34, and a feed conductor 50 extending outward from and spiraling about an axis of rotation formed on second surface 36. An RF connector 60 may be connected to radiating element 30. As an example, the outer ground connector of connector 60 may be connected to spiral arm 38 via solder 62. In one embodiment, planar substrate 32 may be comprised of a Teflon material having glass fibers interspersed therein, such as RT/duroid material manufactured by the Rogers Corporation headquartered in Rogers, Conn., U.S.A. Conductive spiral arms 38 and 40 may extend in a counter-clockwise manner about the axis of rotation. Spiral arms 38 and 40 may be comprised of an electrically conductive material, such as copper. Spiral arms 38 and 40 may be formed, etched, or mounted on dielectric planar substrate 32 by conventional means as recognized in the art. In some embodiments, each of spiral arms 38 and 40 may be a logarithmic spiral having in innermost end 42 and 44, respectively, and an outermost end 46 and 48, respectively. In some embodiments, spiral arms 38 and 40 may be linear spirals.

In operation, spiral arms 38 and 40 make antenna 10 circularly polarized, such that antenna 10 is suitable for satellite signals of circular polarization as well as any orientation of linear polarization. The design of spiral arms 38 and 40 may enable spiral arms 38 and 40 to be "flipped over" such that antenna 10 may be right-hand or left-hand circularly polarized. In accordance with general practice, the polarization of antenna 10 is determined from the hand used when pointing the fingers in the direction of the spiral arm current and thumb in the direction of the radiated fields. Thus, an antenna 10 having spiral arms 38 and 40 wound in the counterclockwise direction would be configured to optimally detect right-hand circular polarization. An antenna 10 having spiral arms 38 and 40 wound in the clockwise direction would be configured to optimally detect left-hand circular polarization.

Radiating element 30 may be readily removable from support structure 20 to allow a user to reorient radiating element 30 with respect to support structure 20. For example, when support structure 20 is placed upon a substantially planar surface, such as ground 90, radiating element 30 may be rotated 180 degrees with respect to an axis parallel to ground 90. To better receive/transmit signals of right hand circular polarization (for example, Global Star satellite system signals), radiating element 30, having spiral arms 38 and 40 wound in the counterclockwise direction of first surface 34, is placed in support structure 20 such that second surface 36 faces toward ground surface 90. Correspondingly, to better receive signals of left-hand circular polarization (for example, GPS satellite system signals), radiating element 30 having spiral arms 38 and 40 wound in the counterclockwise direction of first surface 34, is "flipped over" (i.e., radiating element 30 is placed in support structure 20 such that first surface 34 faces toward ground 90). Antenna 10 may be configured to receive signals of any linear polarization notwithstanding the positioning of radiating element 30.

Feed conductor 50 may be substantially aligned with one of conductive spiral arms 38 and 40. Substantially aligned means that feed conductor 50 lies on the opposite side of planar substrate 32 from one of conductive spiral arms 38 and 40, with the center axis of feed conductor 50 lying within the width of one of conductive spiral arms 38 and 40. The alignment of spiral arm 38 or 40 with feed conductor 50 allows the spiral arm to function as a ground plane for feed conductor 50, allowing feed conductor 50 to function as a tapered microstrip line. Feed conductor 50 may have an innermost end 52 having an innermost width 54 and an outermost end 56 having an outermost width 58. In one embodiment, innermost end 52 is connected to innermost end 42 or 44 of the spiral arm with which feed conductor 52 is not aligned, and outermost end 56 is connected to center conductor of connector 60 by, for example, solder 64. The outer ground conductor of connector 60 is connected close to the outermost end 46 or 48 of spiral arm 38 or 40 with which feed conductor 50 is aligned.

The impedance of feed conductor 50 may be greater at innermost end 52 than at the outermost end 56. For example, the impedance at outermost end 56 may be 50 ohms, while the impedance at innermost end 52 may be 90 ohms. Outermost width 58 may be greater than the innermost width 54, wherein the width of feed conductor 50 gradually narrows from outermost width 58 to innermost width 52. As an example, for an antenna 10 having a planar substrate 32 with a thickness of 0.8 mm, innermost width 54 may be 0.8 mm and outermost width 58 may be 2.4 mm. To enable antenna 10 to cover a wide frequency range, feed conductor 50 operates and provides a constant impedance transformation over a wide frequency range. For example, if the length of feed conductor 50 is 40 cm, it will provide a constant feed transformation from 50 ohms to 90 ohms, allowing a frequency range from approximately 150 MHz to over 4 GHz. In some embodiments, feed conductor 50 may extend in a counter-clockwise manner about the axis of rotation.

The frequency limits of antenna 10 are within the frequency limits of radiating element 30. Referring to FIG. 2A, the lower frequency limit of radiating element 20 may be determined by the distance, $d_{fl}$, between outermost ends 46 and 48 of spiral arms 38 and 40, respectively. The upper frequency limit may be determined by the distance, $d_{fu}$, between innermost ends 42 and 44 of spiral arms 38 and 40, respectively. Thus, radiating element 20 may transmit or receive a broad bandwidth of frequencies within these two geometrically determined limits. As an example, a typical frequency range may be 10:1 or greater. The frequency limits of antenna 10 may be limited by other factors. As an example, in an embodiment where support structure 20 includes a reflector plate at the base thereof, one frequency limiting factor may be that the frequencies must be in the range over which the RF waves reflected upward from the reflector plate are within approximately 90° of being in phase with the waves transmitted directly upward from radiating element 30. This condition may limit frequencies to the approximate range $$\frac{c}{4h} \pm 50\%,$$

or a 3:1 frequency range, where h is the spacing between radiating element 30 and the reflector plate and c is the speed of light. As an example, the frequency range of the passive wide-band low-elevation nulling antenna may be increased by providing multiple support fixtures at different heights h above the reflector plate (see antenna 500 of FIG. 12). The nulling of the antenna pattern at the horizon is not a limiting factor for the frequency range of antenna 10, since the nulling occurs at all frequencies.

In some embodiments, antenna 10 may be placed directly onto ground 90 or pavement without the use of an external reflector. In such embodiments, reflected waves 70 reflected off of ground 90 at higher elevation angles may have an approximately half wavelength of extra path length, putting them approximately in phase with the radiated waves 80 radiated directly from radiating element 30. Waves reflected off the pavement or ground at low angles have nearly the same path length as radiated waves 80, such that the two sets of waves nearly cancel. Referring back to FIG. 1, when RF signals are fed into radiating element 30, radiating element 30 radiates radiated waves 80 upward from first surface 34 and reflected waves 70 downwards from second surface 36. Reflected waves 70 are reflected off of support structure 20 and/or ground 90, where they undergo a 180-degree phase reversal, flow upwards, pass through radiating element 30, and combine with the radiated waves 80. If the bottom portion of support structure 20 was located immediately below radiating element 30, reflected waves 70 and radiated waves 80 would cancel each other out due to the 180-degree reversal. By locating radiating element 30 at height h=¼λ, where λ is the wavelength of the operating frequency of antenna 10, an extra path length of ½λ is added to reflected waves 70 such that they will combine in phase with and reinforce radiated waves 80 for viewpoints directly above antenna 10. As the viewpoint is moved towards the horizon, the difference in the path lengths for radiated waves 80 and reflected waves 70 lessens to zero at the horizon, resulting in a null at the horizon, since the waves are combining 180 degrees out of phase.

In operation, antenna 10 utilizes the principle that the surfaces of dielectric materials such as asphalt, concrete, sand, or soil become efficient reflectors of radio waves at low grazing angles. This is true even if the dielectric material is absorptive of radio waves. This principle enables the user to place antenna 10 onto any reasonably smooth, level outdoor surface, and have this surface provide the reflections that suppress RF signals received from or transmitted to the horizon.

The side walls of housing 40 may be comprised of dielectric material, which allows the radio waves to freely pass through them, such that the waves radiating from the bottom of radiating element 30 may pass from antenna 10 and be reflected to cancel the waves radiated from the top of radiating element 30. Two other contributing factors in the ability of antenna 10 to suppress signals transmitted to or received from the horizon are the planar geometry of radiating element 30, which suppresses vertically polarized waves, and the use of spiral arms 38 and 40, which provide about 7 dB of suppression of the horizontally polarized waves.

The combination of feed conductor 50 and conductive spiral arms 38 and 40 form a balun above 1 GHz, which can suppress currents on the outside of a flexible coaxial transmission line (not shown) that may be coupled to connector 60. Currents on the outer surface of the coaxial transmission line, if not suppressed, can radiate and fill in the nulls at the horizon. In some embodiments, a second balun consisting of ferrite beads on the coaxial transmission line may be included to further suppress signals below 1 GHz.

Figure 13:
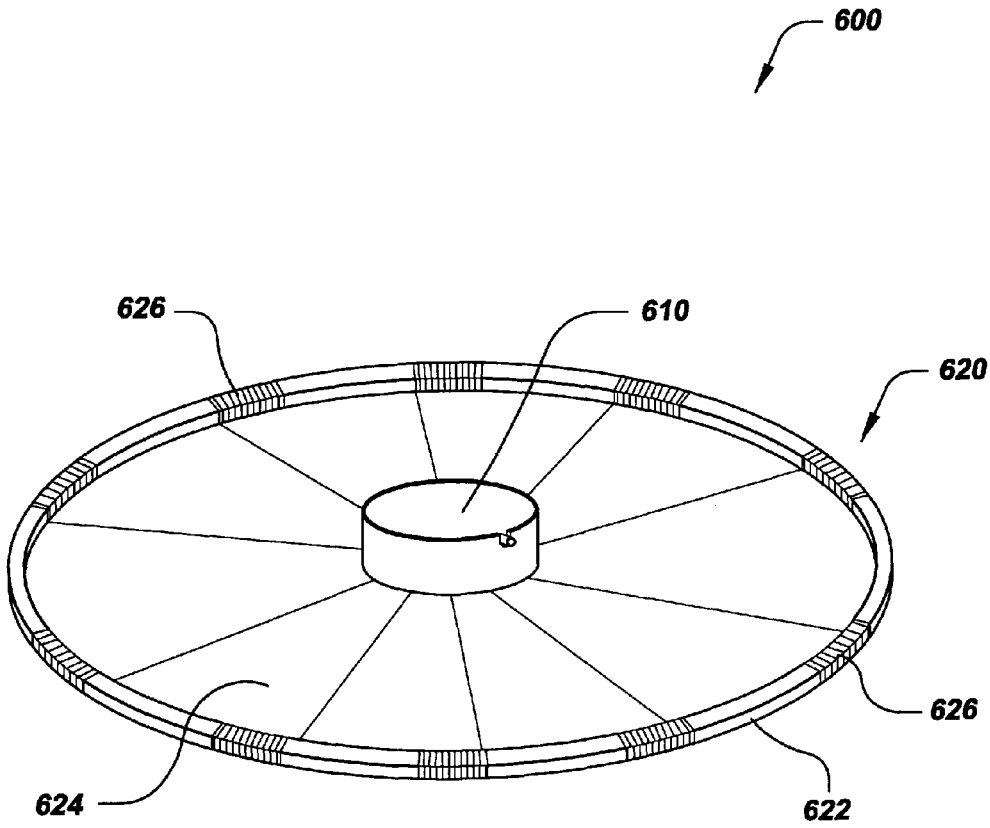
FIG. 13 shows a perspective view of an embodiment of a system including the passive wideband low elevation nulling antenna disposed on an external reflector.

In situations where it is not feasible to place antenna 10 directly onto a reflective surface, such as ground 90, to provide the null at the horizon, it can be placed onto a portable extension reflector (see FIG. 13). In some embodiments, antenna 10 may also be mounted on top of a vehicle or aircraft, with the upper surface of the vehicle or aircraft acting as a reflector. Utilizing the external reflector or the top of a vehicle or aircraft may also suppress signals at the horizon.

Figure 3A:
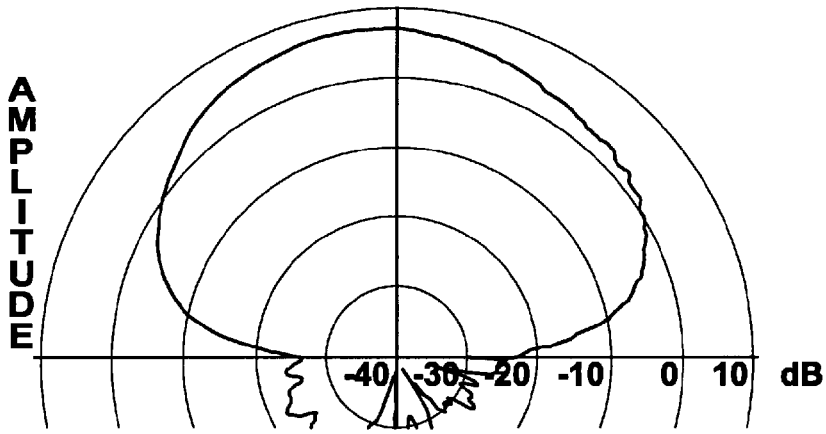
FIG. 3A shows the elevation antenna pattern of an embodiment of the passive wideband low elevation nulling antenna having a vertical polarization.
Figure 3B:
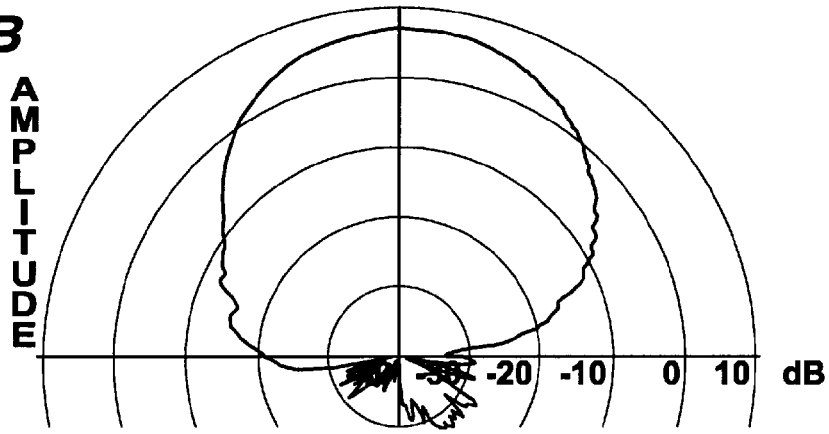
FIG. 3B shows the elevation antenna pattern of an embodiment of the passive wideband low elevation nulling antenna having a horizontal polarization.

Referring to FIGS. 3A and 3B, FIG. 3A shows a measured elevation pattern of antenna 10 for vertical polarization, while FIG. 3B shows a measured elevation pattern of antenna 10 for horizontal polarization. The patterns in FIGS. 3A and 3B show that antenna 10 may produce an omni-directional antenna pattern in azimuth and a broad antenna pattern in elevation, and that antenna 10 achieves a null near the horizon for both polarizations. The null, or signal attenuation, formed near the horizon in the radiation patterns provides for rejection of interference, prevention of jamming of received signals, and interception of transmitted signals by hostile forces.

Referring now to FIGS. 4-7, there is shown another embodiment of the passive wide-band low-elevation nulling antenna 100. Antenna 100 may comprise an antenna housing 110 and a radiating element 130. Radiating element 130 may be contained within a radiating element housing 140. Antenna housing 110 may include a reflector plate 112, a radiating element housing support structure 114 at height h from reflector plate 112, a pair of opposing sidewalls 116 and 118 coupled to a first side 113 of reflector plate 112, a front wall 120 coupled to first side 113 of reflector plate 112, and a back wall 122 coupled to first side 113 of reflector plate 112. Reflector plate 112 may have a first side comprised of a reflective material. Height h may be about one-fourth the wavelength of the operating frequency of antenna 100. Each of pair of opposing sidewalls 116 and 118 may be comprised of a dielectric material and may have a groove 117 and 119 therein. Sidewalls 116 and 118 with grooves 117 and 119 may form radiating element housing support structure 114. Each end of front wall 120 may be coupled to one of the pair of opposing sidewalls 116 and 118. Front wall 120 may be comprised of a dielectric material and may have a height less than height h. Each end of back wall 122 may be coupled to one of opposing sidewalls 116 and 118. Back wall 122 may be comprised of a dielectric material.

Figure 4A:
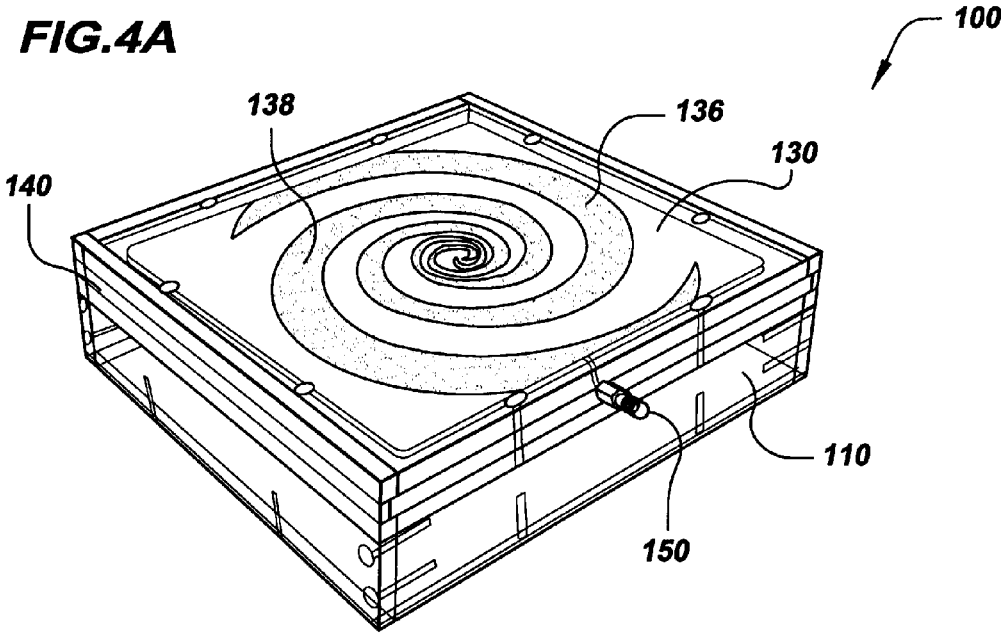
FIG. 4A shows a front perspective view of an embodiment of the passive wideband low elevation nulling antenna.
Figure 4B:
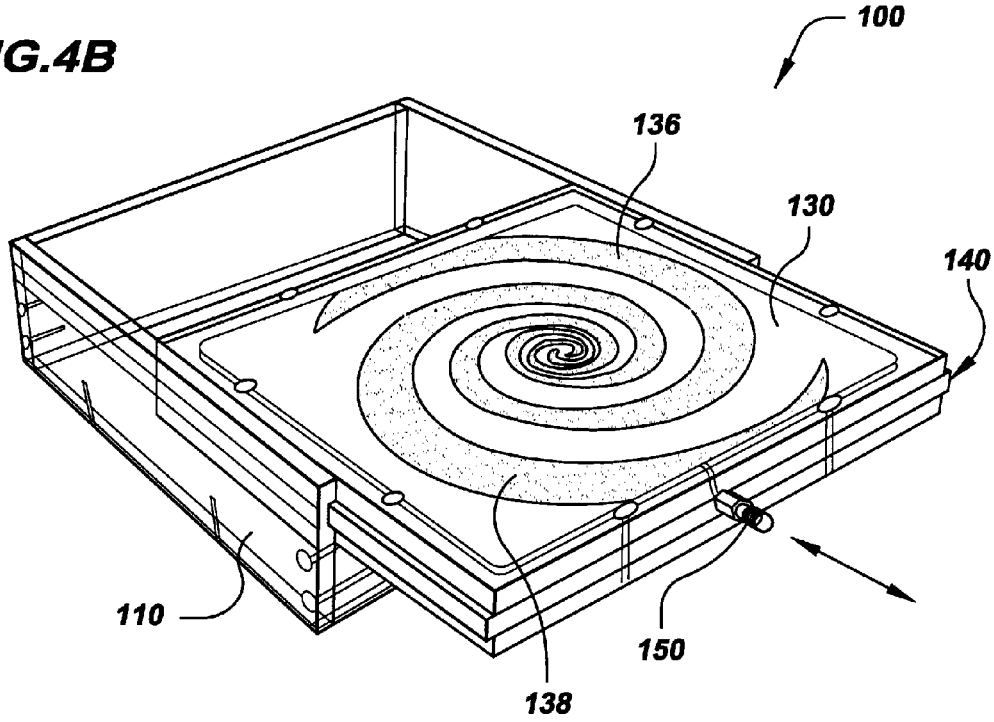
FIG. 4B shows a front perspective view of an embodiment of the passive wideband low elevation nulling antenna, with the radiating element housing partially removed from the antenna housing.
Figure 5A:
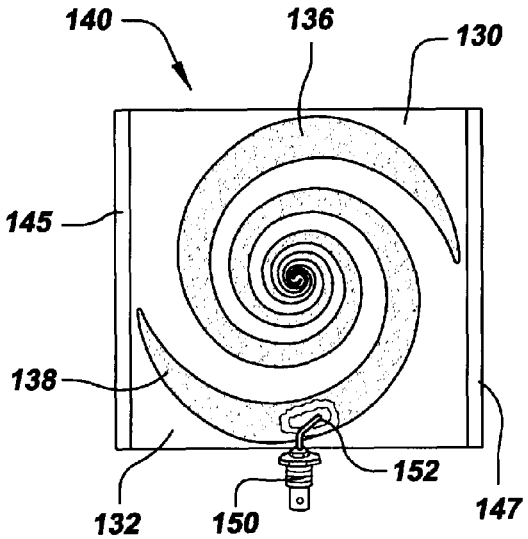
FIG. 5A shows a top view of the first surface of the top portion of an embodiment of the passive wideband low elevation nulling antenna.
Figure 5B:
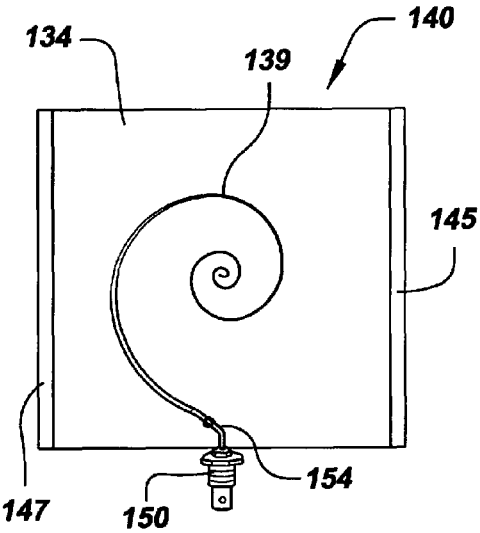
FIG. 5B shows a top view of the second surface of the top portion of an embodiment of the passive wideband low elevation nulling antenna.
Figure 5C:
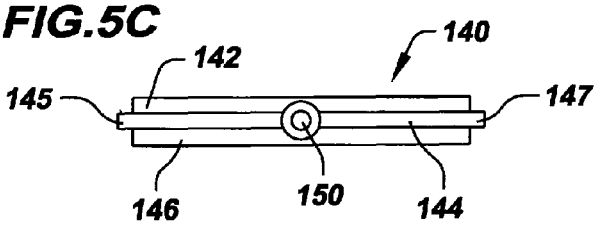
FIG. 5C shows a front view of the top portion of an embodiment of the passive wideband low elevation nulling antenna.
Figure 6A:
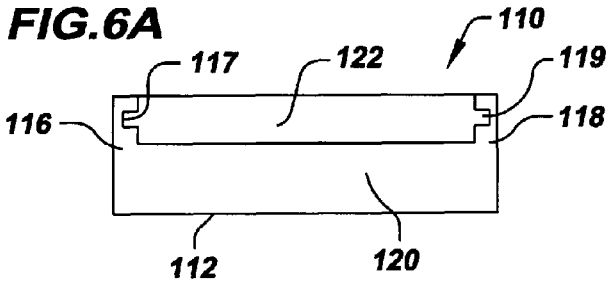
FIG. 6A shows a front view of the bottom portion of an embodiment of the passive wideband low elevation nulling antenna.
Figure 6B:
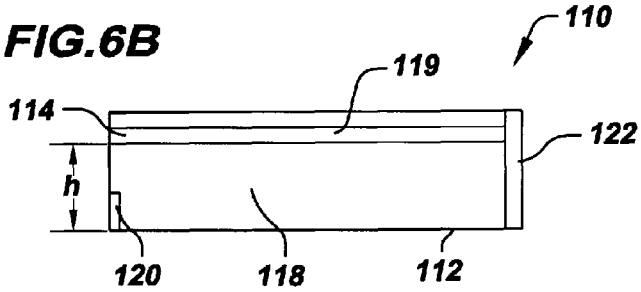
FIG. 6B shows a side view of the bottom portion of an embodiment of the passive wideband low elevation nulling antenna.
Figure 7:
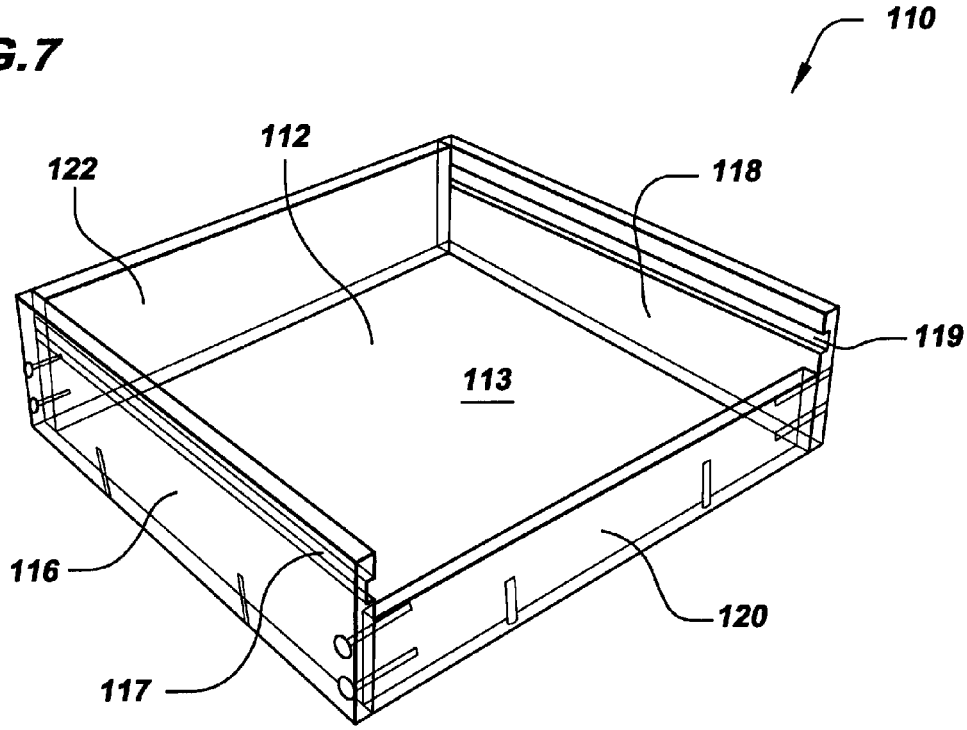
FIG. 7 shows a perspective view of the bottom portion of an embodiment of the passive wideband low elevation nulling antenna.

Reflector plate, along with sidewalls 116 and 118, front wall 120, and back wall 122, may form a base portion, wherein radiating element housing 140 is slidably engaged with the base portion (see FIGS. 4A and 4B). Grooves 117 and 119 may be located within the base portion along the same horizontal plane to allow radiating element housing 140 to be positioned substantially parallel with reflector plate 112. Radiating element housing 140 may comprise a top portion 142, a middle portion 144, and a bottom portion 146 (see FIG. 5C). In some embodiments, radiating element 130 may be contained within middle portion 144. Top portion 142, a middle portion 144, and bottom portion 146 may be coupled together by various means as recognized in the art, such as by nylon screws. Radiating element housing 140 may have a pair of opposing protrusions 145 and 147 on two sides thereof. As an example, middle portion 144 may be wider than top portion 142 and bottom portion 146, such that when combined, protrusions 145 and 147 extend from the sides of radiating element housing 140. Protrusions 145 and 147 may be shaped to slide within each of grooves 117 and 119. When radiating element housing 140 is fully engaged with the base portion, radiating element 130 may be entirely positioned over reflector plate 112 and be substantially parallel with reflector plate 112.

Radiating element housing 140 may be comprised of a dielectric material and may be positioned substantially parallel to reflector plate 112. Radiating element housing 140 may be removable from antenna housing 110 to enable a user to reorient radiating element housing 140 with respect to antenna housing 110. Radiating element housing 140 may be positioned at least partially within antenna housing 110 and may be supported by radiating element housing support structure 114. Radiating element 130 may be positioned substantially parallel to reflector plate 112. Radiating element 130 may include a dielectric planar substrate having a first surface 132 and a second surface 134, at least two conductive spiral arms 136 and 138 extending outward from and spiraling about an axis of rotation formed on first surface 132, and may have a feed conductor 139 coupled second surface 134. Feed conductor 139 may be substantially aligned with one of conductive spiral arms 136 or 138. Radiating element 130 may have an RF connector 150 coupled thereto. The outer ground connector of connector 150 may be connected to one of conductive spiral arms 136 or 138 via, for example, solder 152. The inner RF conductor of connector 150 may be connected to feed conductor 139 via, for example, solder 154. Antenna 100 may produce an omni-directional antenna pattern in azimuth and a broad antenna pattern in elevation with the broad antenna pattern in elevation having a null near the horizon (see FIGS. 3A and 3B).

Figure 8:
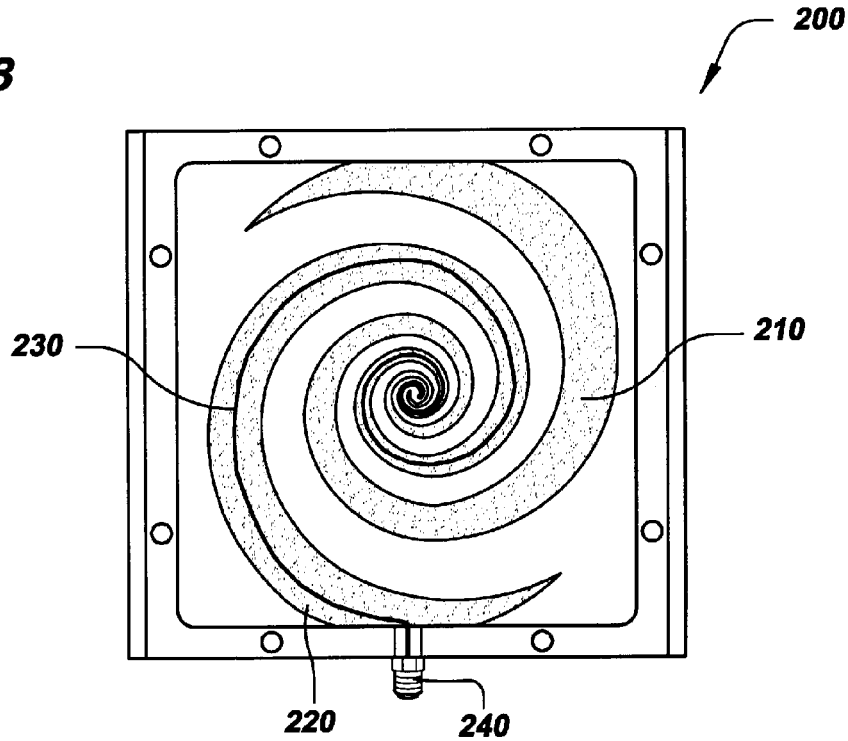
FIG. 8 shows a top view of an embodiment of a radiating element for use within the passive wideband low elevation nulling antenna.

FIG. 8 shows another embodiment of a radiating element 200 for use within antennas 10, 100, or 300 as described herein. Radiating element 200 may include conductive spiral arms 210 and 220. A feed conductor 230 may be located on the same surface as one of conductive spiral arms 210 and 220. As an example, feed conductor 230 may be formed on conductive spiral arm 220. As an example, feed conductor 230 may be a semi-rigid coaxial cable, with inner RF and outer ground conductors comprised of copper separated by a flexible dielectric material such as Teflon. The central RF conductor may be connected to spiral arm 230 at the center of the antenna. The location of feed conductor 230 on one of conductive spiral arms 210 and 220 may allow for ease of manufacture of radiating element 200 compared with radiating elements having feed conductor 230 on the opposite side of the conductive spiral arms. Radiating element 200 may also contain an RF connector 240 for sending/receiving RF transmissions.

Figure 9A:
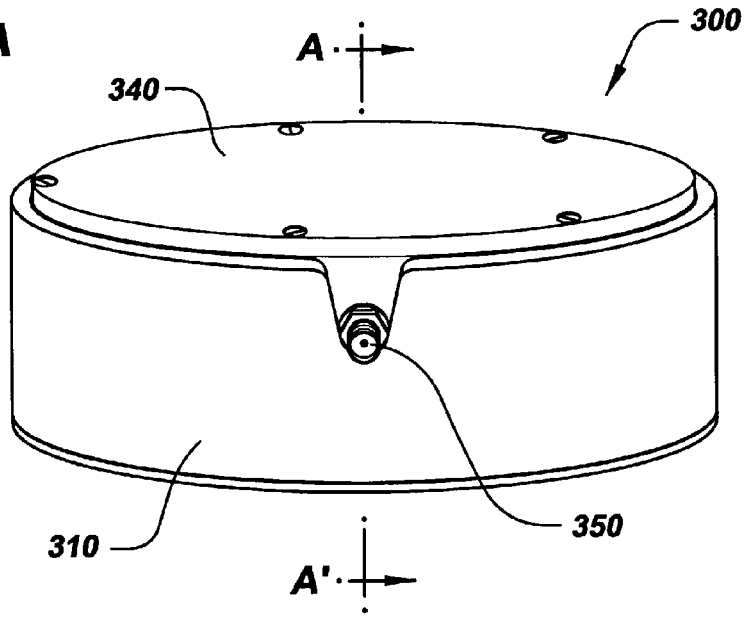
FIG. 9A shows a front perspective view of an embodiment of the passive wideband low elevation nulling antenna.
Figure 9B:
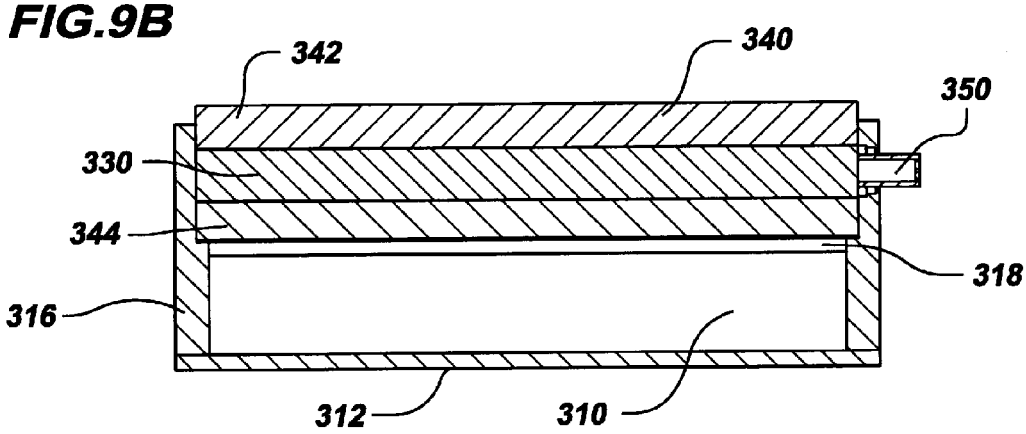
FIG. 9B shows a cross-section view along the line A-A' of FIG. 9A, of an embodiment of the passive wideband low elevation nulling antenna.
Figure 9C:
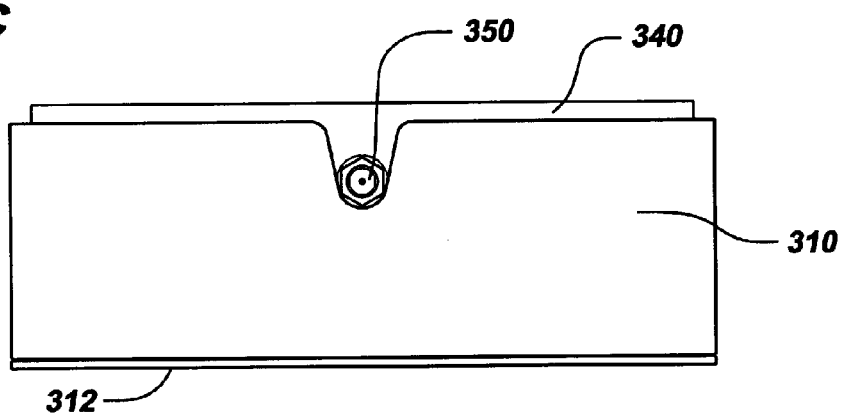
FIG. 9C shows a front view of an embodiment of the passive wideband low elevation nulling antenna.
Figure 10:
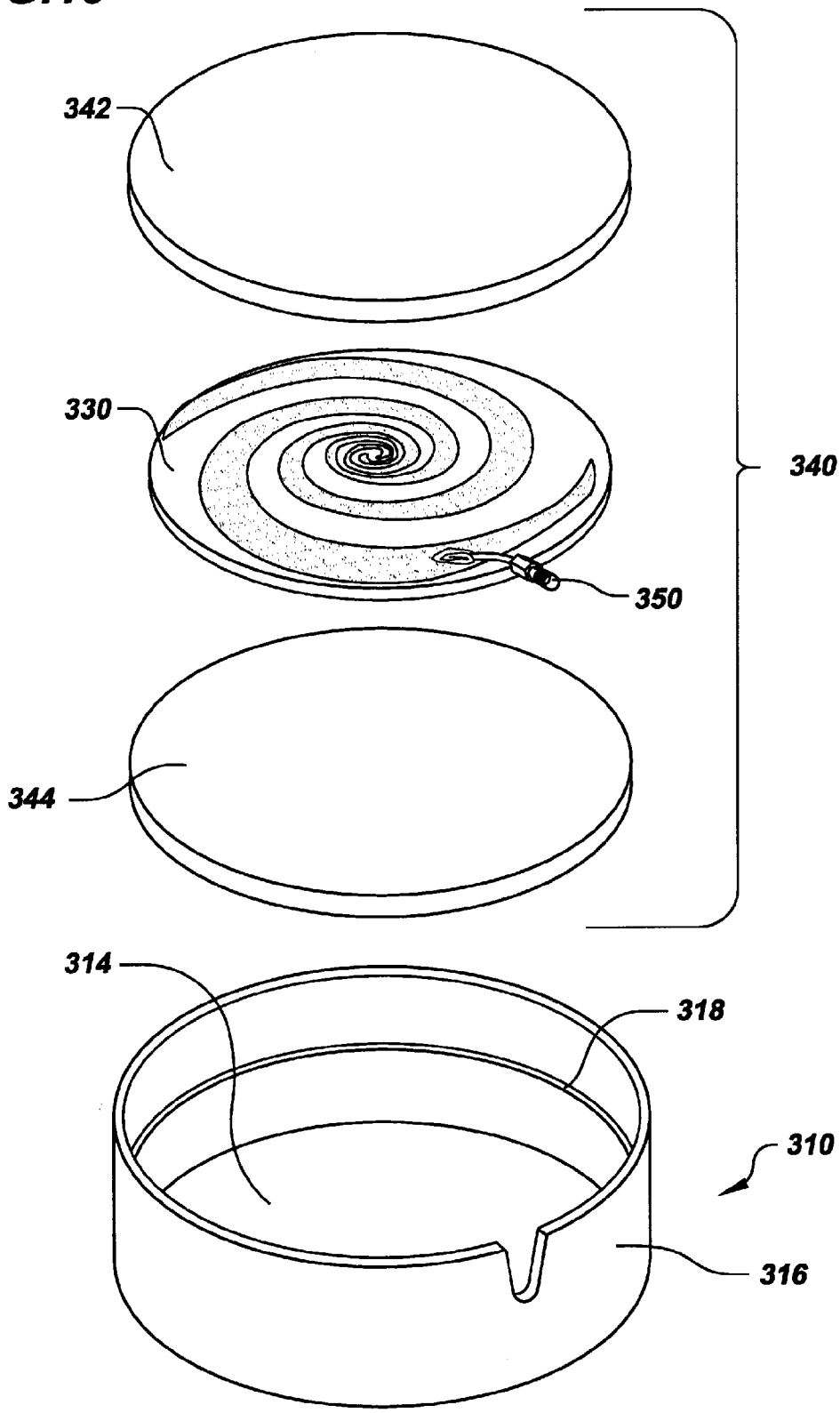
FIG. 10 shows an exploded view of an embodiment of the passive wideband low elevation nulling antenna.

Referring now to FIGS. 9-10, there is shown another embodiment of the passive wide-band low-elevation nulling antenna 300. Antenna 300 may include an antenna housing 310 and a radiating element 330. Radiating element 330 may be contained within a radiating element housing 340. Radiating element 330 may be similar to radiating elements 30 and 130 as disclosed herein, with modifications in size and shape. In some embodiments, radiating element 330 may be similar to radiating element 200. Antenna housing 310 may include a reflector plate 312 having a first side 314, a cylindrically shaped wall 316 disposed along the circumference of first side 314, and a radiating element housing support structure. Wall 316 may be comprised of a dielectric material, such as G10 polymer, to allow radiated waves to freely pass through wall 316 such that the waves radiating from a second side of radiating element 330 may pass from antenna 300 and be reflected to cancel the waves radiated from a first surface of radiating element 330.

Radiating element housing support structure may comprise a ridge 318 formed within the interior surface of wall 316. Ridge 318 may be located at about height h from reflector plate 312, wherein height h is about one-fourth the wavelength of the operating frequency of antenna 300. Height h may be varied depending on the wavelength of the operating frequency of antenna 300. For example if h is set at 4.7 centimeters, antenna 300 may operate in the frequency range of about 800 MHz to about 2.4 GHz. Radiating element housing 340 may be comprised of a dielectric material and positioned parallel to reflector plate 312. Radiating element housing 340 may be removable from antenna housing 310 to enable a user to reorient radiating element housing 340 with respect to antenna housing 310. Radiating element housing 340 may be comprised of a top portion 342 and a bottom portion 344, with radiating element 330 positioned in between. Radiating element housing 340 may be positioned at least partially within antenna housing 310 and supported by radiating element housing support structure 318. Radiating element 330 may be positioned parallel to reflector plate 312.

Figure 11A:
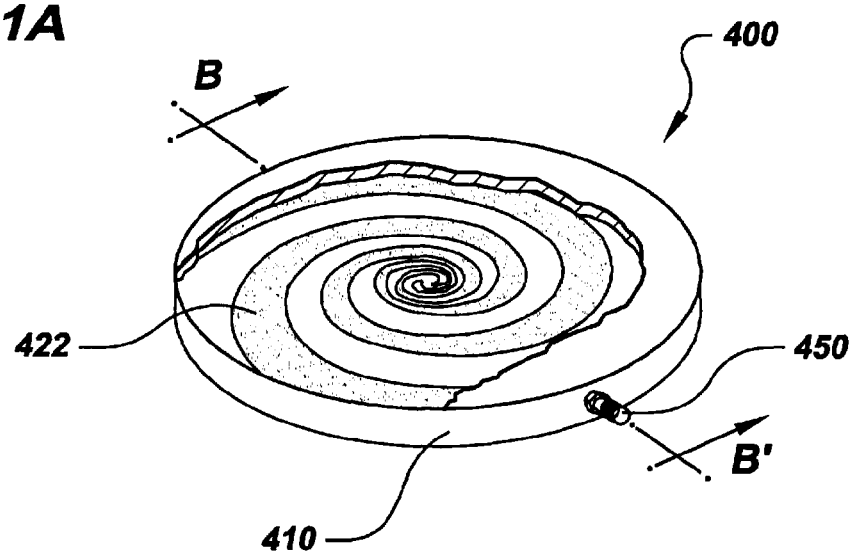
FIG. 11A shows a perspective view of an embodiment of a radiating element for use within a passive wideband low elevation nulling antenna.
Figure 11B:
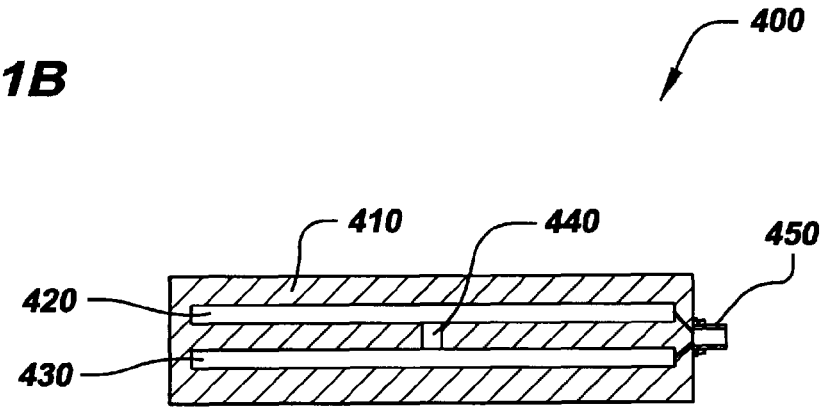
FIG. 11B shows a cross-section view along the line B-B' of FIG. 11A, of an embodiment of a radiating element for use within a passive wideband low elevation nulling antenna.

FIGS. 11A and 11B show an embodiment of a radiating structure 400 for use within a passive wide-band low-elevation nulling antenna, such as antennas 10, 100, and 300 as described herein. Radiating structure 400 may include a housing 410, a first element 420 disposed within housing 410, and a second element 430 disposed within housing 410. Housing 410 may be comprised of a dielectric material. First element 420 may be comprised of two or more conductive spiral arms 422. Conductive spiral arms 422 may be similar to conductive spiral arms 38 and 40. Second element 430 may be comprised of a feed conductor (not shown). Feed conductor may be similar to feed conductor 50. The feed conductor may be electrically connected by conductive spiral arms 422 by a connection 440 between first element 420 and second element 430. An RF connector 450 may be coupled to both first element 420 and second element 430, to allow radiating structure 400 to transmit/receive signals. Housing 410 may comprise various shapes, such as circular, rectangular, or square, and may vary in size depending on the dimensions of the particular antenna housing in which radiating structure 400 is located.

Figure 12:
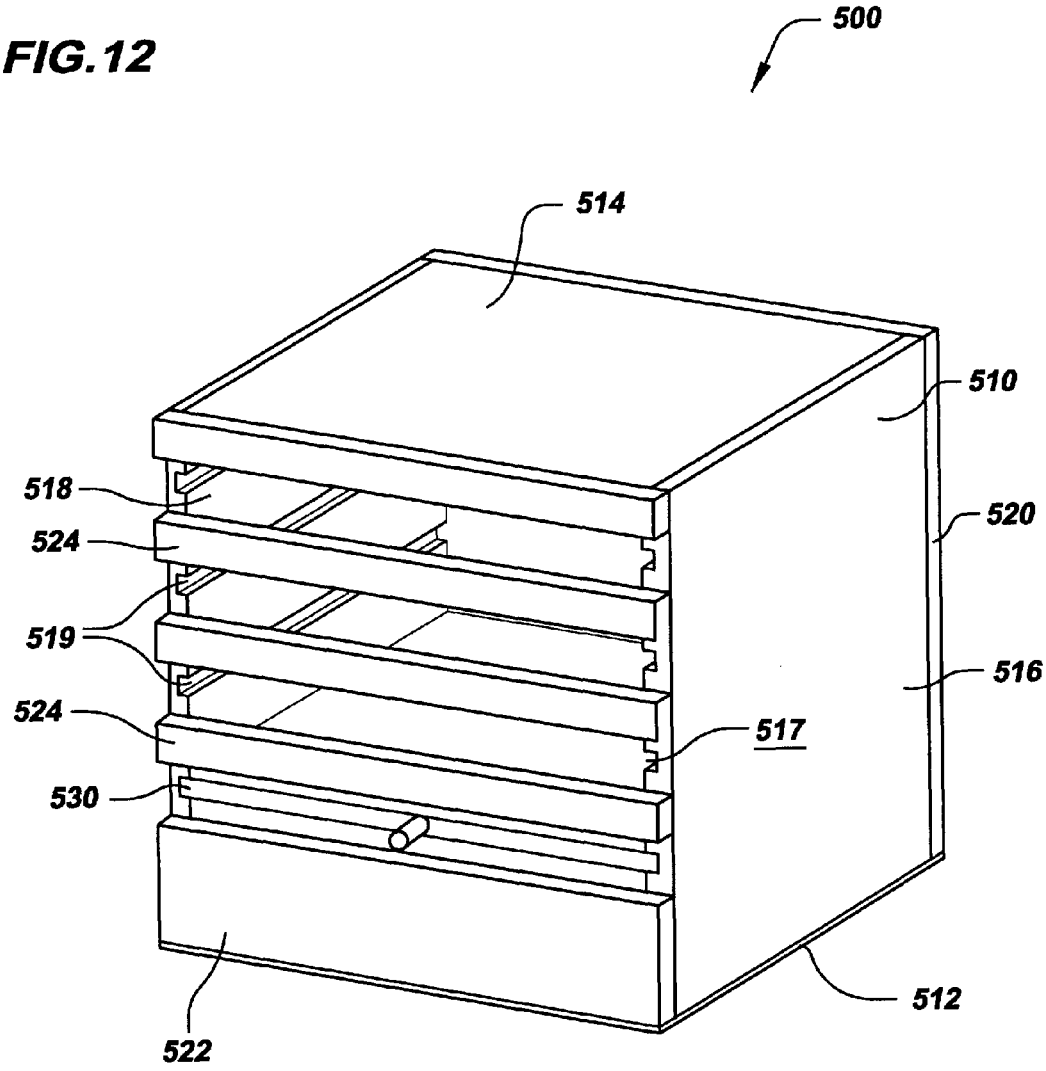
FIG. 12 shows a perspective view of an embodiment of the passive wideband low elevation nulling antenna having a height adjustment structure.

FIG. 12 shows a perspective view of an embodiment of the passive wideband low elevation nulling antenna having a height adjustment structure 500. Antenna 500 may include a support structure 510 and a radiating element (not shown) contained within a radiating element housing 530. Radiating element housing 530 may be similar to radiating element housing 140 as disclosed herein. The radiating element may be similar to radiating elements 30 and 130 as disclosed herein, with modifications in size and shape. In some embodiments, the radiating element may be similar to radiating element 200. Support structure 510 may comprise a base 512, a first side wall 516 coupled to base 512, a second side wall 518 coupled to base 512, a back wall 520 coupled to base 512, a front wall 522 coupled to base 512, and more than one support beams 524 coupled to first side wall 516 and second side wall 518. First side wall 516 may be positioned opposite second side wall 518. First side wall 516 and second side wall 518 may each have more than one grooves 517 and 519, respectively, formed therein to receive protrusions from radiating element housing 530. Each groove 517 in first side wall may be located on the same horizontal plane as each groove 519 in second side wall 518.

More than one pairs of grooves 517 and 519 allow for radiating element housing 530 to be located at different heights with respect to base 512. This feature may allow for antenna 500 to optimally transmit/receive signals at different frequencies. The spacing between each groove 517 within first side wall 516 or between each groove 519 within second side wall 518 may vary depending on many factors, such as the thickness of radiating element housing 530 and the height of support structure 510. One end of front wall 522 may be coupled to first side wall 516 and the other end of front wall 522 may be coupled to second side wall 518. Front wall 522 may have a height less than the pair of opposing grooves, 517 and 519, positioned nearest to base 512. One end of back wall 520 may be coupled to first side wall 516. The other end of back wall 520 may be coupled to second side wall 518. Radiating element housing 530 may be slidably engaged within support structure 510 such that, when radiating element housing 530 is fully engaged with support structure 510, the radiating element is entirely positioned over base 512. Support beams 524 may help support radiating element housing 530 when radiating element housing is positioned above the grooves 517 and 519 located nearest base 512.

Each height level setting of antenna 500 may provide a frequency range ratio of about 3:1. For example, at the first height level adjustment of 4.7 centimeters, the frequency range of antenna 500 may be from about 800 MHz to about 2.4 GHz. The total frequency range ratio of antenna 500 using all available height settings may be about 10:1. For example, the low end frequency of antenna 500 may be between about 700-800 MHz, while the high-end frequency range of antenna 500 may be between about 10-12 GHz. The frequency range of antenna 500 may vary depending on the height of antenna 500, the configuration of radiating element, as well as the design and/or type of materials used for antenna 500.

FIG. 13 shows a perspective view of a system 600 including an embodiment of the passive wideband low elevation nulling antenna 610 operatively coupled to an external reflector 620. External reflector 620 may be used as a reflective surface in situations where it may not be feasible to place antenna 610 directly onto the ground or pavement, such in trees or marshes, or where the ground is not level. Antenna 610 may be similar to antennas 10, 100, 300, or 500 as discussed herein. To ensure the best transmission/reception of signals, antenna 610 may be placed on external reflector 620 in the center of external reflector 620. External reflector 620 may be comprised of a hoop 622 with a flexible reflector element 624 secured thereto by one or more connectors 626, with flexible reflector element 624 being disposed within the interior region of hoop 622. Hoop 622 may be comprised of a sturdy, but flexible material, such as fiberglass. Flexible reflector element 624 may be comprised a flexible conductive material, such as conductive cloth, and may have a size of about four feet in diameter. Flexible reflector element 624 may have a design on both surfaces thereof (not shown), to allow external reflector 620 to blend in with particular environments. For example, flexible reflector element 624 may have a camouflage design on both sides. Connectors 626 may be secured on one end to hoop 622 and may be configured to be secured around hoop 622. For example, connectors 626 may be designed to hook around hoop 622. As another example, connectors 622 or may be comprised of a flexible material, such as Velcro®, one end of which is sewn to flexible reflector element 624, and the other end of which may wrap around hoop 622 to secure flexible reflector element 624 to hoop 622.

Many modifications and variations of the passive wide-band low-elevation nulling antenna are possible in light of the above description. Therefore, within the scope of the appended claims, the passive wide-band low-elevation nulling antenna may be practiced otherwise than as specifically described. Further, the scope of the claims is not limited to the embodiments disclosed herein, but extends to other embodiments as may be contemplated by those with ordinary skill in the art.

We claim:

1. An antenna comprising:

a radiating element comprising a dielectric planar substrate having a first surface and a second surface, at least two conductive spiral arms extending outward from and spiraling about an axis of rotation formed on the first surface, and a feed conductor extending outward from and spiraling about an axis of rotation formed on the second surface, the feed conductor substantially aligned with one of the conductive spiral arms; and a support structure coupled to the radiating element, wherein when the support structure is placed upon a substantially planar surface the radiating element is positioned at height h from the planar surface, wherein height h is about one-fourth the wavelength of the operating frequency of the antenna.

2. The antenna of claim 1, wherein the conductive spiral arms extend in a counter-clockwise manner about the axis of rotation.

3. The antenna of claim 1, wherein the feed conductor extends in a counter-clockwise manner about the axis of rotation.

4. The antenna of claim 1, wherein each of the conductive spiral arms is a logarithmic spiral having an outermost end and a tapered innermost end.

5. The antenna of claim 1, wherein the feed conductor has an innermost end having an innermost width and an outermost end having an outermost width, wherein the impedance of the feed conductor is greater at the innermost end than at the outermost end.

6. The antenna of claim 5, wherein the outermost width is greater than the innermost width, wherein the width of the feed conductor gradually narrows from the outermost width to the innermost width.

7. The antenna of claim 1, wherein the operating frequency of the antenna is between about 700 MHz and about 12 GHz.

8. The antenna of claim 1, wherein the radiating element is removable from the support structure to allow a user to reorient the radiating element with respect to the support structure.

9. The antenna of claim 8, wherein when the support structure is placed upon a substantially planar surface the radiating element may be rotated 180 degrees with respect to an axis parallel to the planar surface.

10. The antenna of claim 1, wherein the antenna produces an omni-directional antenna pattern in azimuth and a broad antenna pattern in elevation, the broad antenna pattern in elevation having a null near the horizon.

11. The antenna of claim 1, wherein the radiating element is contained within a radiating element housing comprised of a dielectric material, the radiating element housing having a pair of opposing protrusions on two sides thereof, each of the pair of opposing protrusions extending the length of a side of the radiating element housing.

12. The antenna of claim 11, wherein the support structure comprises a base having a first side;

a first side wall and a second side wall coupled to the first side, the first side wall positioned opposite the second side wall, the first side wall and the second side wall each having more than one grooves formed therein to receive one of the pair of opposing protrusions, wherein each groove in the first side wall lies on the same horizontal plane as each groove in the second side wall;

a front wall coupled to the first side, one end of the front wall coupled to the first side wall and the other end of the front wall coupled to the second side wall, the front wall having a height less than the pair of opposing grooves positioned nearest the base; and a back wall coupled to the first side, one end of the back wall coupled to the first side wall and the other end of the back wall coupled to the second side wall;

wherein the radiating element housing is slidably engaged within the support structure, and wherein when the support structure is placed upon a substantially planar surface the radiating element may be positioned at various heights h from the planar surface.

13. The portable antenna of claim 1, further comprising an external reflector operatively coupled thereto, the external reflector comprising a hoop defining an interior region; and a flexible reflector element secured to the hoop by one or more connectors, the flexible reflector element disposed within the interior region, wherein the portable antenna may be operatively coupled to the external reflector to provide a reflective surface.

14. A portable antenna comprising:

an antenna housing comprising a reflector plate forming the base of the antenna housing, the reflector plate having a first side, one or more side walls coupled to the first side, and a radiating element housing support structure formed within the interior of at least one of the one or more side walls, the radiating element housing support structure positioned at height h from the reflector plate, wherein height h is about one-fourth the wavelength of the operating frequency of the antenna; and a radiating element contained within a radiating element housing comprised of a dielectric material, the radiating element housing positioned at least partially within the antenna housing and supported by the radiating element housing support structure, the radiating element housing removable from the antenna housing to allow a user to reorient the radiating element housing with respect to the antenna housing, the radiating element positioned substantially parallel to the reflector plate, the radiating element comprising a dielectric planar substrate having a first surface and a second surface, at least two conductive spiral arms extending outward from and spiraling about an axis of rotation formed on the first surface, and a feed conductor formed on the second surface, the feed conductor substantially aligned with one of the conductive spiral arms wherein the portable antenna produces an omni-directional antenna pattern in azimuth and a broad antenna pattern in elevation, the omni-directional antenna pattern and the broad antenna pattern both having a null near the horizon.

15. The portable antenna of claim 14, wherein the one or more side walls includes a cylindrically shaped wall disposed along the periphery of the first side, wherein the radiating element housing support structure comprises a ridge formed within the interior surface of the cylindrically shaped wall.

16. The portable antenna of claim 15, wherein the radiating element housing is comprised of a dielectric material and positioned substantially parallel to the reflector plate, the radiating element housing removable from the antenna housing to allow a user to reorient the radiating element housing with respect to the antenna housing.

17. The portable antenna of claim 14, wherein the one or more side walls and the reflector plate comprise a base portion, wherein the one or more side walls comprise a pair of opposing sidewalls coupled to the first side of the reflector plate, each of the pair of opposing sidewalls having a groove therein, the grooves forming the radiating element housing support structure, a front wall coupled to the first side of the reflector plate, each end of the front wall coupled to one of the pair of opposing sidewalls, the front wall having a height less than the groove located on each of the pair of opposing sidewalls, and a back wall coupled to the first side of the reflector plate, each end of the back wall coupled to one of the pair of opposing sidewalls wherein the radiating element housing is slidably engaged with the base portion, the radiating element housing having a pair of opposing protrusions on two sides thereof, the protrusions shaped to slide within each of the grooves, wherein when the radiating element housing is fully engaged with the base portion the radiating element is entirely positioned over the reflector plate.

18. The portable antenna of claim 16, wherein the grooves are located within the base portion along the same horizontal plane to allow the radiating element housing to be positioned substantially parallel with the reflector plate.

19. A portable antenna comprising:

an antenna housing comprising a base having a first side comprised of a reflective material, one or more side walls coupled to the first side, and a radiating element housing support structure formed within the interior of at least one of the one or more side walls, the radiating element housing support structure positioned at height h from the base, wherein height h is about one-fourth the wavelength of the operating frequency of the antenna; and a radiating element contained within a radiating element housing comprised of a dielectric material, the radiating element housing positioned at least partially within the antenna housing and supported by the radiating element housing support structure, the radiating element housing removable from the antenna housing to allow a user to readily reorient the radiating element housing with respect to the antenna housing, the radiating element positioned substantially parallel to the base, the radiating element comprising a planar substrate comprised of a dielectric material, at least two conductive spiral arms formed within the planar substrate, and a feed conductor formed within the planar substrate, the feed conductor having an innermost end and an outermost end, wherein the impedance of the feed conductor is greater at the innermost end than at the outermost end.

* * * * *